US005519475A

United States Patent [19]

Miyamoto et al.

[11] Patent Number: 5,519,475

[45] Date of Patent: May 21, 1996

[54] IMAGE FORMING APPARATUS WITH PERIPHERAL SPEED DIFFERENCE BETWEEN IMAGE BEARING AND TRANSFER MEMBERS

[75] Inventors: Toshio Miyamoto, Yokohama; Koichi Tanigawa; Kazuaki Ono, both of Tokyo, all of Japan

[73] Assignee: Canon Kabushiki Kaisha, Tokyo, Japan

[21] Appl. No.: 301,573

[22] Filed: Sep. 7, 1994

[30] Foreign Application Priority Data

Sep. 7, 1993 [JP] Japan ..... 5-247588

[51] Int. Cl.[6] ..... G03G 15/14

[52] U.S. Cl. ..... 355/271; 355/326 R; 430/126

[58] Field of Search ..... 355/271, 273, 355/274, 275, 326 R, 327; 430/126

[56] References Cited

U.S. PATENT DOCUMENTS

| | | | |
|---|---|---|---|
| 4,674,857 | 6/1987 | Satomura et al. | 355/271 |
| 4,682,880 | 7/1987 | Fujii et al. | 355/327 |
| 5,091,751 | 2/1992 | Inoue et al. | 355/274 |
| 5,153,654 | 10/1992 | Yuminamochi et al. | 355/277 |
| 5,223,900 | 6/1993 | Yuminamochi et al. | 355/273 |
| 5,370,961 | 12/1994 | Zaretsky et al. | 430/126 |
| 5,394,226 | 2/1995 | Beardsley et al. | 355/271 X |

*Primary Examiner*—William J. Royer

*Attorney, Agent, or Firm*—Fitzpatrick, Cella, Harper & Scinto

[57] ABSTRACT

An image forming apparatus includes an image bearing member; a device for forming a toner image on the image bearing member; an intermediate transfer member for receiving the toner image from the image bearing member; and wherein the intermediate transfer member has an average surface roughness which is smaller than one half a size of one pixel.

2 Claims, 11 Drawing Sheets

FIG. 7(a)
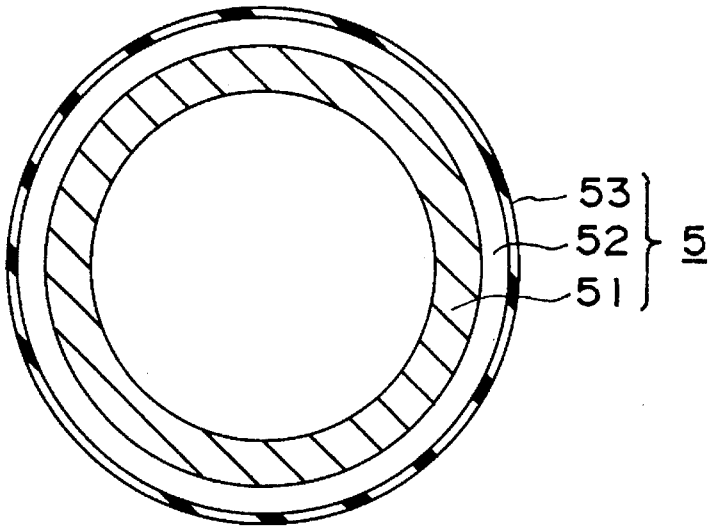
$R_Z \fallingdotseq 7\mu m$
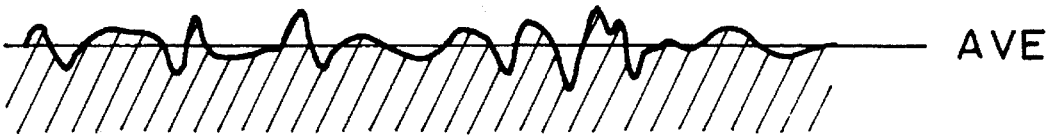
FIG. 7(b)

IMAGE FORMING APPARATUS WITH PERIPHERAL SPEED DIFFERENCE BETWEEN IMAGE BEARING AND TRANSFER MEMBERS

FIELD OF THE INVENTION AND RELATED ART

The present invention relates to an image forming apparatus such as a copying machine, printer or the like, using an electrophotographic process, more particularly to an image forming apparatus wherein a toner image is temporarily transferred onto an intermediate transfer member from an image bearing member, and thereafter, the toner image is transferred from the intermediate transfer member onto a recording material.

An image forming apparatus using the intermediate transfer member is advantageous in a color image forming apparatus, in which different color toner images are sequentially superimposed on the same recording material to form one image. This is because there is no need of curving the recording material, unlike a color image forming apparatus in which the recording material is wrapped on the peripheral surface of a transfer drum, and the toner images are transferred from the image bearing member onto the wrapped recording material, and therefore, image formation is possible on a thick and rigid recording material.

However, it involves a problem that the image formed on the recording material is rough or is disturbed in some cases. The inventors' investigations have revealed that there occurs no color misregistration and that one dot image, particularly in the case of a halftone image, is rough irrespective of the number of superimpositions. Thick character images and solid images are of no problem.

The cause of the problem is considered to be the surface elastic layers, such as a rubber layer of the intermediate transfer member, which layer is provided to increase the image transfer efficiency from the image bearing member onto the intermediate transfer member. The provision of the elastic layer permits higher pressure between the intermediate transfer member and the image bearing member, and therefore, the transfer efficiency is increased due to the physical factor. However, by the non-smoothness of the surface of the elastic layer slightly deviates the toner particles transferred from the image bearing member on the elastic layer, which results in the disturbance of the output image. In the case of the thick lines or solid images, the deviations of the toner particles due to the non-smoothness of the surface of the elastic layer are not remarkable by human eyes. However, in the case of the halftone image with which thin lines are combined, the slight deviation of the toner particles are remarkable.

SUMMARY OF THE INVENTION

Accordingly, it is a principal object of the present invention to provide an image forming apparatus with which the output image is not disturbed.

According to an aspect of the present invention, there is provided an image forming apparatus in which the surface roughness of the intermediate transfer member is smaller than one half the length of one pixel size.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7, (a) schematically shows a layer structure of an intermediate transfer roller having a smooth surface layer; and (b) schematically shows surface pits and projections of the intermediate transfer roller.

DESCRIPTION OF THE PREFERRED EMBODIMENTS

Figure 1:
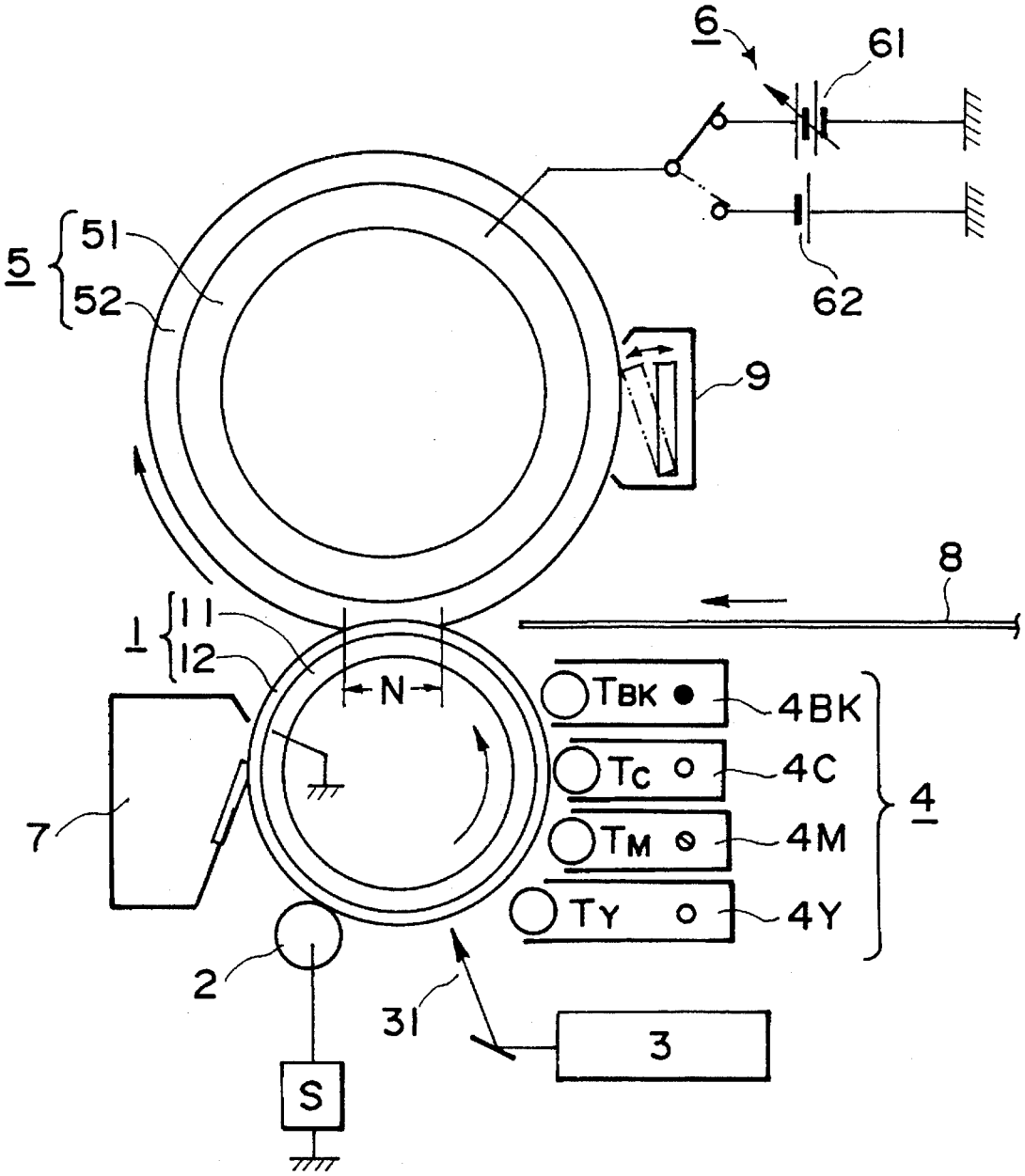
FIG. 1 is a schematic sectional view of a laser beam printer having a color image forming function using electrophotographic process and using an intermediate transfer member, according to an embodiment of the present invention.

Referring to FIG. 1, there is shown an image forming apparatus using an intermediate transfer member, according to a first embodiment of the present invention. The image forming apparatus of this embodiment is in the form of a laser beam printer of an electrophotographic type capable of forming color images.

In the Figure, designated by a reference numeral 1 is a first image bearing member in the form of a rotatable electrophotographic photosensitive member (drum), which is repeatedly usable. It comprises an electroconductive cylinder 11 of aluminum or the like, a photosensitive layer 12 of an organic photoconductor thereon. It is rotatable in a counterclockwise direction indicated by an arrow at a predetermined peripheral speed.

Designated by reference numerals 2, 3, 4, 5 and 7 are image forming process means disposed around the photosensitive drum 1, and are respectively a primary charger, a laser scanner, four color developing device, an intermediate transfer member, and a cleaner, respectively.

The primary charger 2 is in the form of a contact type charging roller, and is press-contacted to the surface of the photosensitive drum 1 at a predetermined pressure, and is rotated by the photosensitive drum 1. The roller 2 is supplied with a predetermined charging bias voltage from a bias voltage source, by which an outer peripheral surface of the rotating photosensitive drum 1 is uniformly charged to a predetermined polarity and to a predetermined potential.

The four color developing device 4 comprises a four developing devices, namely, a yellow developing device 4Y, a magenta developing device 4M, a cyan developing device 4C and a black developing device 4BK, which contains yellow toner Ty, magenta toner Tm, cyan toner Tc (chromatic colors) and black toner Tbk (non-chromatic color), respectively.

The intermediate transfer member 5 is in the form of a rotatable roller having a circumferential length slightly longer than the length of the transfer material 8 and it comprises a metal core 51, an intermediate resistance elastic layer 52 having an intermediate resistance of $10^5$–$10^{10}$ ohm, preferably $10^7$–$10^9$ ohm, the intermediate resistance elastic layer being made of urethane, EPDM, chloroprene or the like or one of these materials in which carbon, zinc oxide, tin oxide or another electroconductive material is dispersed. The hardness thereof (Asker C) is 20–50 degrees, preferably 30–40 degrees.

In this embodiment, the intermediate transfer roller 5 has a resistance of $10^8$ ohm, a hardness of 35 degrees. It is abraded to provide a ten point average roughness Rz (JIS B0601) which is smaller than one half the length (diameter) L of one pixel (approx. 42 μm in this embodiment).

The intermediate transfer roller 5 is press-contacted to the photosensitive drum 1 at a predetermined pressure, and is rotated in the same peripheral directions at the same peripheral speed as the photosensitive drum 1 or with a predetermined peripheral speed difference.

When a toner image is transferred from the photosensitive drum onto the intermediate transfer roller, the metal core 51 is supplied with a bias voltage (positive in this embodiment) of the polarity opposite from that of the toner, from a first voltage source 61 of the transfer bias voltage source 6.

The description will be made as to image forming operations of the apparatus of this embodiment.

(1) The photosensitive drum 1 is uniformly charged to a predetermined polarity (negative) and to a predetermined potential by the charging roller 2 while it is rotated. Subsequently, the charged surface is exposed to a scanning laser beam 31 bearing a first component color image (yellow component color image) of the intended color image information, by a laser scanner 3, so that an electrostatic latent image is formed corresponding to the first color component.

Thereafter, the electrostatic latent image is reverse-developed into a first color yellow toner image by the first developing device (yellow developing device) 4Y for the first color component. During this operation, the other developing devices 4M, 4C and 4BK are inoperative.

Then, at a transfer nip N where the photosensitive drum 1 and the intermediate transfer roller 5 are contacted to each other, the yellow toner image is temporarily transferred onto the outer peripheral surface of the intermediate transfer roller 5 from the photosensitive drum 1. At this time, the metal core 51 of the intermediate transfer roller is supplied with a bias voltage (positive) of a predetermined voltage and of the opposite polarity from the toner, from the first source 61 of the transfer bias voltage source 6, by which the yellow toner image is transferred by the transfer electric field from the outer peripheral surface of the intermediate transfer roller 5 from the surface of the photosensitive drum 1.

After the completion of the yellow toner image transfer (first color) to the intermediate transfer roller 5 is completed, the surface of the photosensitive drum 1 is cleaned by a cleaner 7.

The similar operations are repeated as follows.

(2) Charging of the rotating photosensitive drum 1; laser beam scanning with a second color component image (magenta, for example); development by the second developing device (magenta developing device) 4M; transfer, onto the intermediate transfer roller 5, of the magenta toner image (second color image); cleaning of the surface of the photosensitive drum 1 by the cleaner 7.

(3) Charging of the rotating photosensitive drum 1; laser beam scanning for a third color component image (cyan component image, for example); development by a third developing device (cyan developing device) 4*c;* transfer, onto the intermediate transfer roller 5, of the cyan toner image (third color); and cleaning of the surface of the photosensitive drum 1 by the cleaner 7.

(4) Charging of the rotating photosensitive drum 1; laser beam scanning for a fourth component color image (black component image); development by a fourth developing device (black developing device) 4BK; transfer, onto the intermediate transfer roller 5, of the black toner image (fourth color); and cleaning of the surface of the photosensitive drum 1 by the cleaner 7.

By the execution of the image forming and transfer cycles described above, the four component color toner images, namely, yellow toner image, magenta toner image, cyan toner image, black toner image are transferred onto the outer peripheral surface of the rotating intermediate transfer roller 5 with these images registered, so that a combined color image corresponding to the color image information, is formed.

The transfer bias voltage during the transfer operation of the second color (magenta toner) onto the transfer roller 5, has the polarity which is the same as in the first color transfer, but has a voltage level having an absolute value slightly larger than in the first color image transfer. This is in order to compensate for the weakening of the transfer bias electric field due to the electric charge of the toner image of the first color.

The transfer bias voltage during the cyan toner image transfer (third color) to the intermediate transfer roller 5, for the same reason, has the polarity which is the same as in the toner image transfer for the first and second colors, but has a voltage level having a absolute value slightly larger than in the toner image transfer for the second color.

Briefly, the absolute value of the transfer bias voltage gradually increases from the first color to the second color, from the second color to the third color.

The order of toner image formations from the first color to the fourth color is not limited to that described above, but may be properly determined by one skilled in the art.

When the transfer of the fourth color toner image onto the intermediate transfer roller 5, is completed, a transfer material 8 is fed at a predetermined timing from an unshown sheet feeding mechanism, to the transfer nip N where the photosensitive drum 1 and the intermediate transfer roller 5 are contacted.

At this time, the transfer bias voltage is switched by using a second voltage source 62 of the transfer bias voltage source 6, so that a bias voltage of the same polarity (negative in this example) as that of the toner is applied to the intermediate transfer roller.

By doing so, the first–fourth laminated toner images on the outer peripheral surface of the intermediate transfer roller 5 are transferred at once onto the transfer material 8. Thus, a combined color toner image is transferred onto and formed on the transfer material 8.

The transfer material 8 having passed through the transfer nip N is subjected to a toner image fixing operation (nearing, pressing or the like) by an unshown image fixing device, and it is discharged as a print.

Designated by a reference numeral 9 is a cleaner for the intermediate transfer roller 5, and is normally out of contact from the intermediate transfer roller, but is brought into contact with the intermediate transfer roller 5 after the completion of the toner image transfer onto the transfer material 8 from the intermediate transfer roller 5, by which it cleans the intermediate transfer roller 5.

Additionally, the second source 62 applies to the intermediate transfer roller 5 the bias voltage having the same polarity as the toner, so as to transfer the residual toner on the intermediate transfer roller 5 back to the surface of the photosensitive drum 1. The toner transferred back to the photosensitive drum surface is removed by the cleaner 7 from the photosensitive drum 1. By doing so, the intermediate transfer roller 5 is cleaned, by which the cleaner 9 for the intermediate transfer roller can be omitted.

In the apparatus of this embodiment, the intermediate transfer roller 5 as the intermediate transfer member has a resistance of $10^8$ ohm, and a hardness of 35 degrees, and a ten point average surface roughness Rz (JIS B0601) which is approx. 15 μm, which is smaller than one half the diameter L of one pixel (approx. 42 μm in this embodiment).

Figure 2:
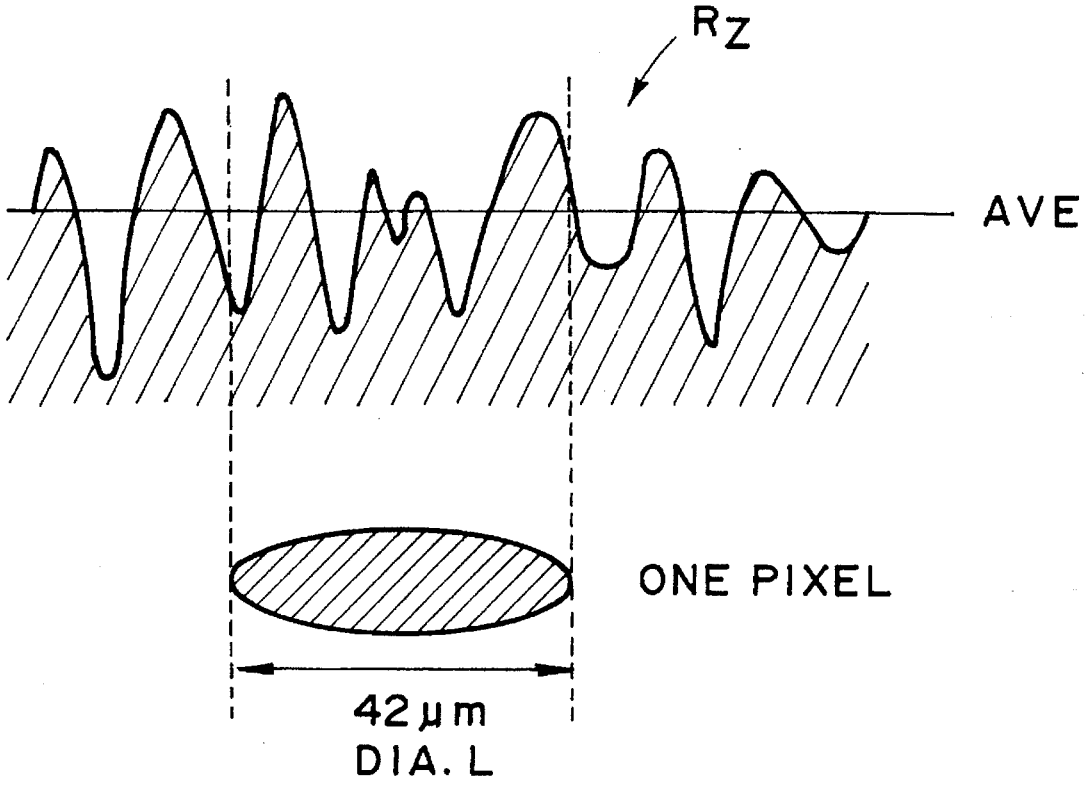
FIG. 2 illustrates a comparison between the surface roughness of the intermediate transfer roller and a size of one pixel.

FIG. 2 schematically compares one pixel size and the surface roughness of the intermediate transfer roller 5. The apparatus of this embodiment has a resolution of 600 dpi, and therefore, one pixel has a size of approx. 42 μm. Correspondingly, the diameter of the laser beam spot by the laser beam exposure 31 for forming the latent image on the photosensitive drum 1, has a circular configuration having a diameter of 42 μm.

The surface of the intermediate transfer roller 5 more particularly the elastic layer 52 has a number of pits and projections as shown in FIG. 2, when it is enlarged. The size of the pits and projections is sufficiently smaller as compared with the size of one half the diameter L of the single pixel.

Figure 3:
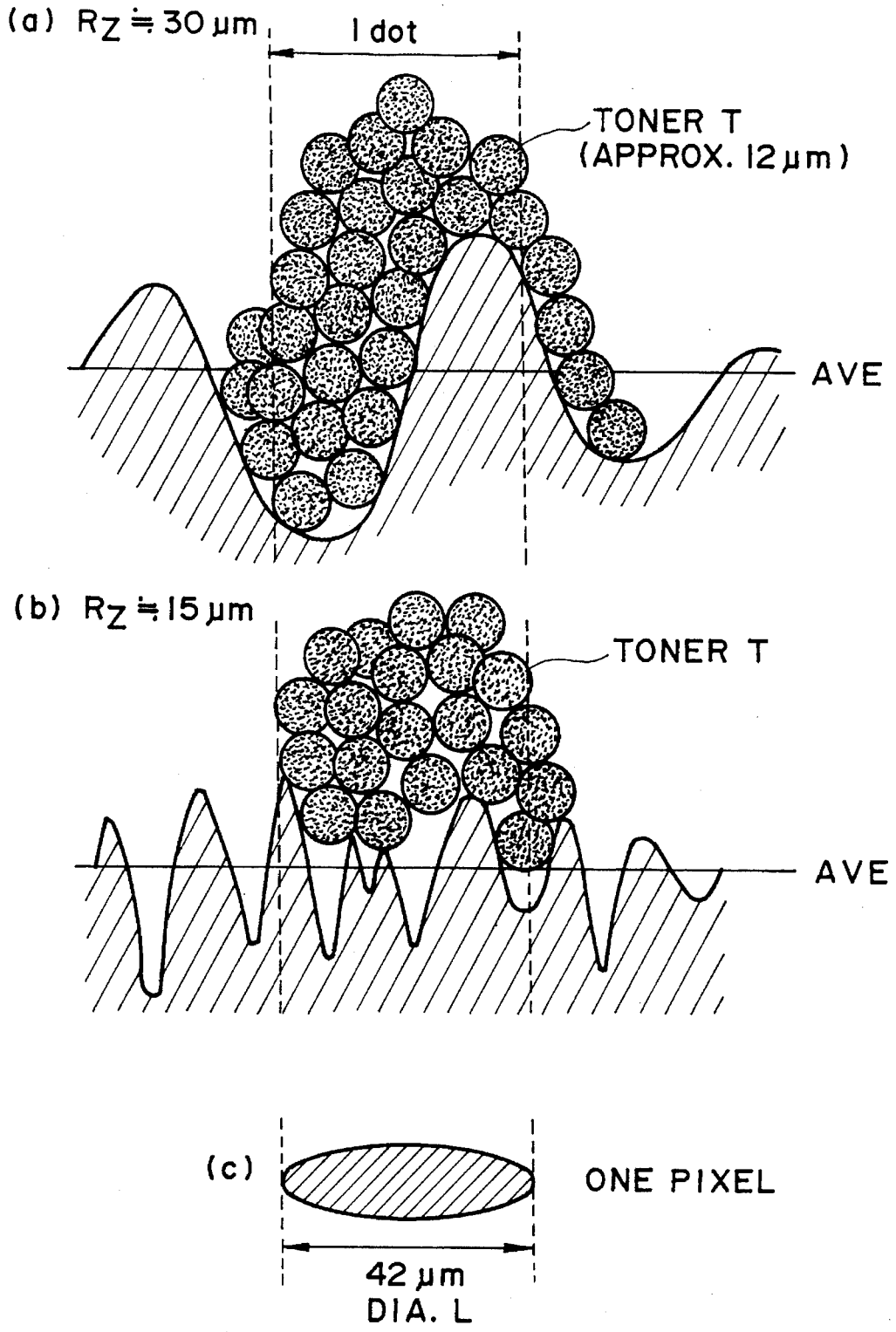
FIG. 3, (a) schematically shows surface pits and projections of an intermediate transfer roller having a surface roughness Rz of approx. 30 μm, and toner particles when 1 dot spot image is formed thereon; (b) shows the surface pits and projections of an intermediate roller having a surface roughness Rz of approx. 15 μm, and the toners of one dot spot image formed thereon; and (c) illustrates a diameter of one pixel size.

By doing so, one dot image can be faithfully reproduced, as will be shown in FIGS. 3(*a*)–3(*c*).

FIG. 3, (a) illustrates the surface pits and projections of the intermediate transfer roller having a surface roughness Rz of approx. 30 μm, and the toner particles when one dot spot image is formed thereon.

FIG. 3, (b) illustrates surface pits and projections of the intermediate transfer roller having a surface roughness Rz of approx. 15 μm, and toner particles when one dot spot image is formed thereon.

The toner T has a particle size (diameter) of approx. 12 μm.

As will be understood from FIG. 3, (a), the surface pits and projections of the intermediate transfer roller 5 is larger than one half the diameter L of one pixel, and therefore, the one dot image of the toner is destroyed. However, in the case of (b) where Rz is approx. 15 μm, the pits and projections of the surface of the intermediate transfer roller 5 smaller than one half the diameter L of one pixel, and therefore, the one dot image of the toner is hardly destroyed.

Figure 4:
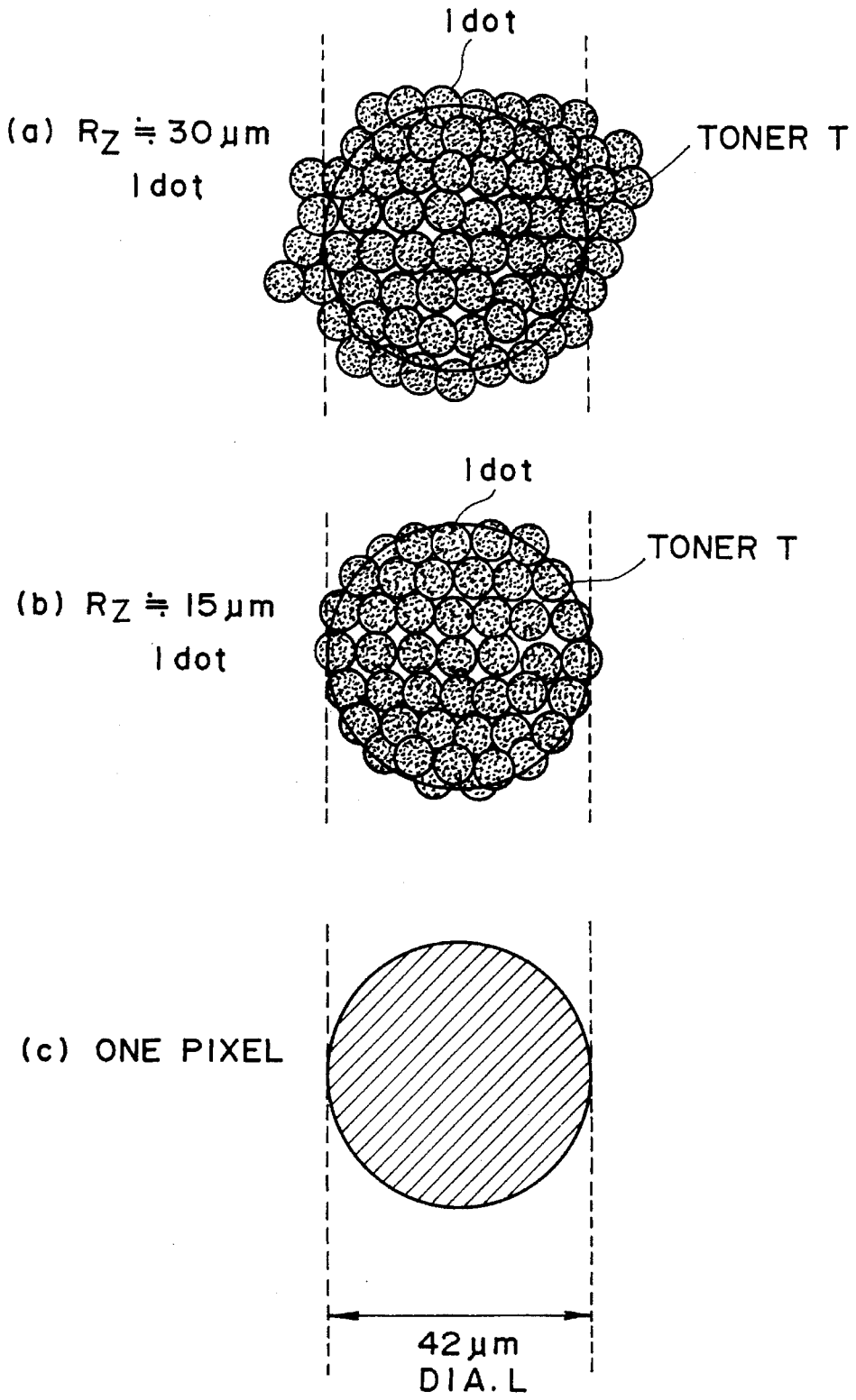
FIG. 4 schematically shows a printed one dot image; (a) deals with an intermediate transfer roller having a surface roughness Rz of 30 μm; (b) deals with an intermediate transfer roller having a surface roughness Rz of 15 μm; and (c) shows a diameter of one pixel size.

FIGS. 4(*a*)–4(*c*) schematically show the actual print of the one dot image. In the case of the intermediate transfer roller having a surface roughness Rz of approx. 30 μm, the toner image from one dot latent image is destroyed and enlarged significantly, however, in the case of the intermediate transfer roller having a surface roughness Rz of approx. 15 μm, the toner image is not enlarged from the latent image, and therefore, faithful reproduction is possible.

The foregoing explanations are based on microscopic observation of the surface of the intermediate transfer roller. Macroscopically, the comparison has been made with respect to a halftone image of 1 dot and 3 spaces (1 dot width toner images are formed with 3 dot width spaces), the image is rough when Rz is approx. 30 μm, but the images are fine and clean without toner scattering when Rz is approx. 15 μm.

The experiments by the inventors are summarized in Table 1 below.

TABLE 1

| Rz | 1 dot Half tone | 2 dot Halftone | Thick character | Solid black |
|---|---|---|---|---|
| 60 μm | NG | NG | G | G |
| 30 μm | NG | G | G | G |
| 15 μm | G | G | G | G |
| 8 μm | G | G | G | G |

Diameter L of one dot is approx. 42 μm.

Diameter L of 2 dots is approx. 84 μm.

"G" means that no problem is observed in the output image.

"NG" means that image disturbances are observed on the output image.

From Table 1, it will be understood that good images can be provided in the case of halftone images, if the surface roughness Rz of the intermediate transfer roller 5 is smaller than ½ of the diameter L of the minimum dots of the print image.

It will also be understood that thick character images and solid black images are not influenced by the surface roughness Rz of the intermediate transfer roller 5.

Figure 5:
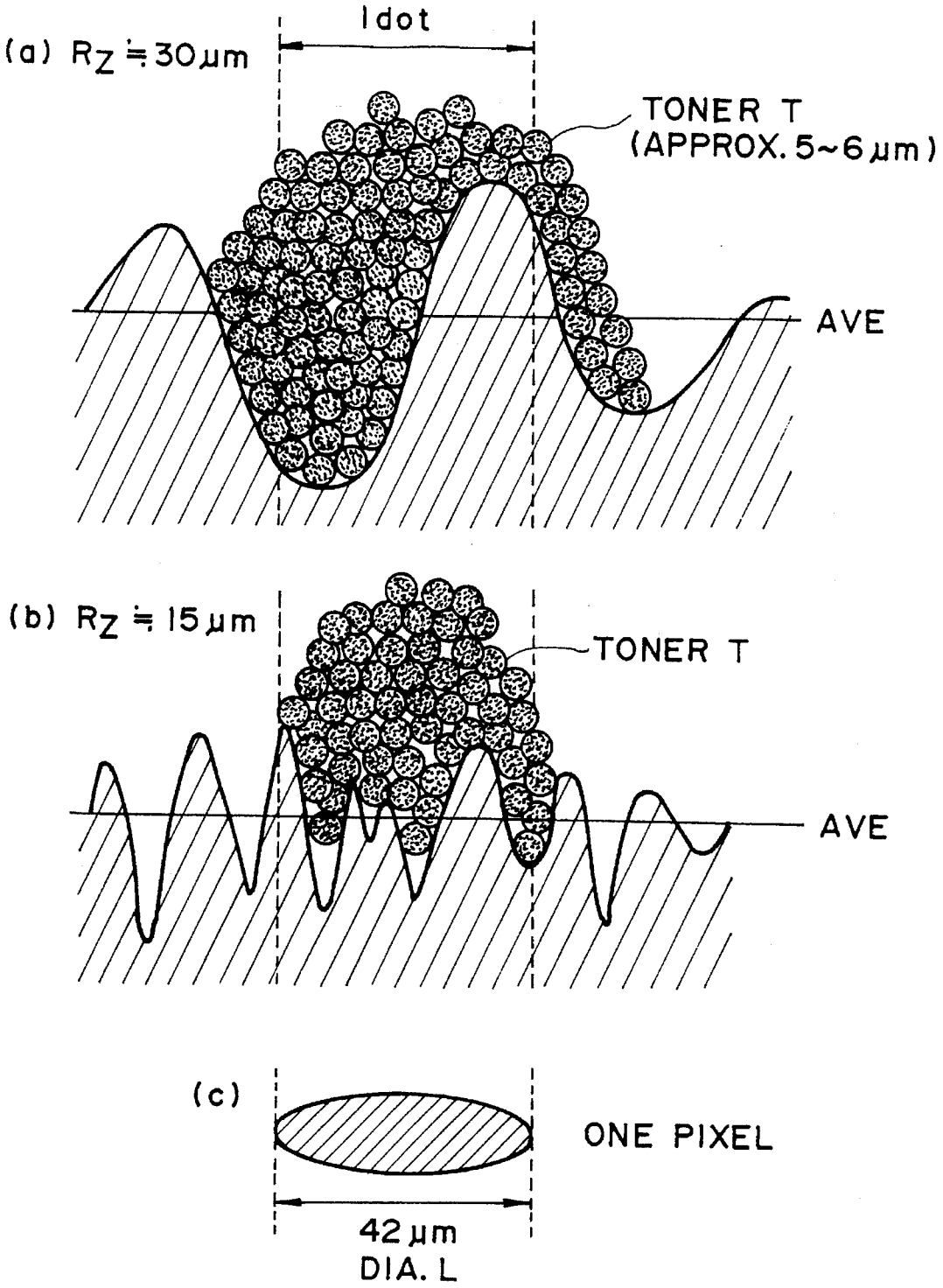
FIG. 5, (a) schematically shows surface pits and projections of an intermediate transfer roller having a surface roughness Rz of approx. 30 μm, and toner particles of one dot spot image formed thereon, wherein fine toner particles having a particle size of 5–6 μm are used; (b) shows surface pits and projections of an intermediate transfer roller having a surface roughness Rz of approx. 30 μm, and toner particles of one dot spot image formed thereon wherein fine toner particles having a particle size of 5–6 μm are used; (c) shows a diameter of one pixel size.

FIGS. 5(*a*)–5(*c*) show the states where the toner particle sizes are different. In the FIGS. 5(*a*)–5(*c*) examples, the particle size of the toner used is 5–6 μm (fine particle toner).

In order to print precise images, the reduction of the toner particle size is a significant factor. When the fine particle toner is used, a significant advantageous effect is confirmed.

The fine particle toner is more influenced by the surface roughness of the intermediate transfer roller 5 as compared with the normal size toner particle (approx. 12 μm). As shown in FIG. 5, (a), when Rz is approx. 30 μm, the toner particles flow into the pits with the result that the toner image is enlarged as compared with one dot of the latent image. When the intermediate transfer roller has the surface roughness Rz of approx. 15 μm, as shown in FIG. 5, (b), the toner image is not influenced by the pits and projections, and the latent image is faithfully reproduced.

When a comparison is made in the actual prints, the roughness and toner scattering are significantly less when the intermediate roller has a surface roughness Rz of approx. 15 μm than when a surface roughness of approx. 30 μm, in the halftone image formation of 1 dot and 3 spaces.

Figure 6:
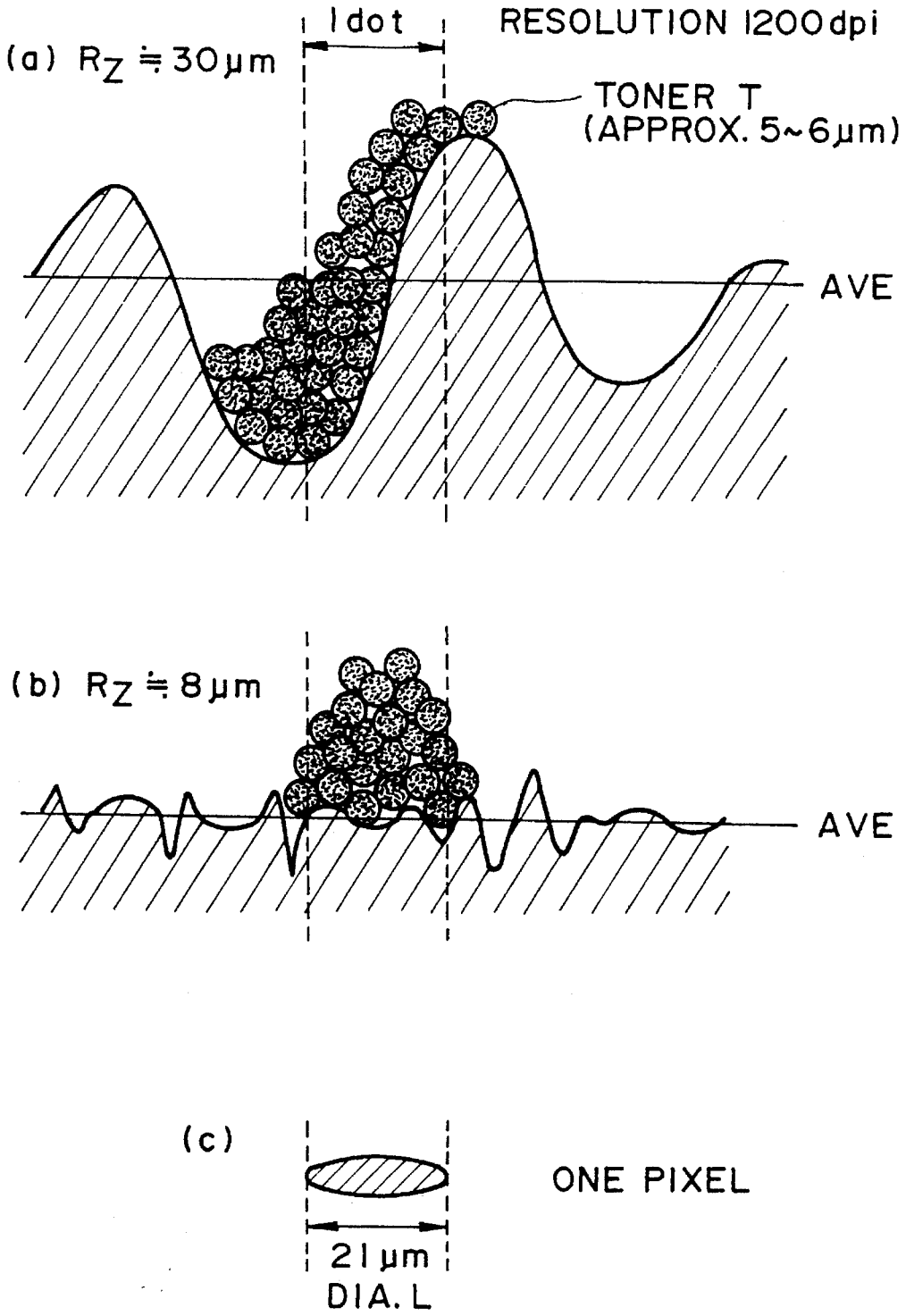
FIG. 6 shows surface pits and projections of an intermediate roller and toner particles when one dot spot image is formed thereon, when the image resolution is increased up to 1200 dpi, and the fine toner particles having the particle size of 5–6 μm are used; (a) deals with the intermediate transfer roller having a surface roughness Rz of approx. 30 μm; (b) deals with an intermediate transfer roller having a surface roughness Rz of approx. 8 μm; (c) shows a diameter of one pixel size.

FIGS. 6(*a*)–(*c*) deal with a further increased image resolution. In this Figure, the resolution is increased up to 1200 dpi. The toner has the same particle size of 5–6 μm.

In this case, high precision image formation is possible, but image non-uniformity due to the surface roughness of the intermediate transfer roller 5 becomes more conspicuous.

The present invention is effective in this case. As will be understood from FIG. 6, in the case of a surface roughness of approx. 30 μm (a), the toner particles flow into the pits with the result that the size of the image is approx. doubled as compared with a one dot latent image. In the case of Rz is approx. 8 μm, a one dot image is faithfully reproduced without influence by the surface roughness.

In the case of the intermediate transfer roller 5 in FIG. 6, (b), since the resolution is 1200 dpi, one pixel size is approx. 21 μm, and the ten point average surface roughness Rz of the surface of the intermediate transfer roller is preferably 10.5 μm or smaller. In consideration, the intermediate transfer roller is finished to provide approx. 8 μm of the surface roughness Rz, in this embodiment.

In high precision image formation, the effects of the present invention are very significant. More particularly with the conventional intermediate transfer member, a halftone image using one dot is disturbed and not clean, but the intermediate transfer member of this embodiment is capable of clean and non-disturbed images.

Figure 11:
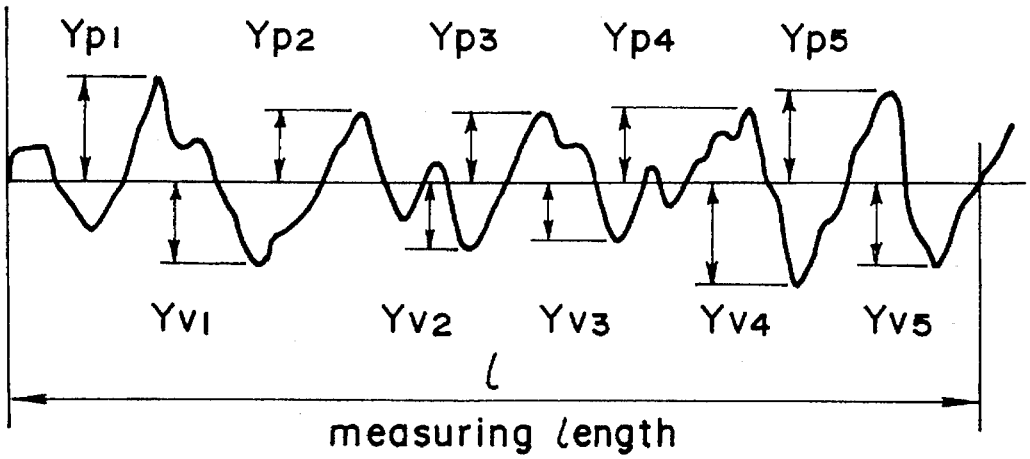
FIG. 11 illustrates a method of determining a ten point average surface roughness.

The ten point average surface roughness Rz is determined in the following manner (FIG. 11).

Rz is the average value of the absolute values of the heights of the five highest profile peaks and the depths of the five deepest profile valleys within the measuring length.

$$Rz=\Sigma|ypi|+\Sigma|yvi|/5$$

where ypi is the height of the i-th nighest peak profile, yvi is the depth of the i-th deepest profile valley.

Referring to FIGS. 7(*a*)–(*b*), a second embodiment of the present invention will be described, in which the same printer as in FIG. 1 is used, but the intermediate transfer roller 5 has a smooth intermediate resistance layer (approx. $10^8$ ohm) as the surface layer 53, as shown in FIG. 7, (a). The other structures are the same as in FIG. 1. The smooth surface layer 53 has a thickness of 50 μm of nylon or the like in which electroconductive fine particles such as carbon are dispersed. The surface layer was produced by a dipping method.

According to this embodiment, the ten point average surface roughness Rz can be reduced without surface machining or abrading. In this embodiment, Rz is approx. 7 μm, which means that the surface of the intermediate transfer roller 5 is smoother than in the first embodiment, as will be understood from FIG. 7, (b).

The smooth surface layer 53 is significantly effective when precision images are printed as in the first embodiment, and in addition, the surface of the intermediate transfer member is more easily cleaned.

In this embodiment, the smooth surface layer 53 is produced by a dipping method, but this method is not limiting, and another method such as a spray method or a tube coating method or the like are usable. The material is not limited to nylon, but urethane rubber is usable, provided that the surface has sufficient smoothness.

A third embodiment will be described, in which the same printer as in the first embodiment is used, but a peripheral speed difference is imparted between the photosensitive drum 1 and the intermediate roller 5. The other structures are the same as in FIG. 1.

When the process speed of the printer is Vp; the peripheral speed of the photosensitive drum 1 is Vd; and the peripheral speed of the intermediate transfer roller 5 is Vt, then the peripheral speed of the photosensitive drum is equal to the process speed. In this embodiment, the peripheral speed of the intermediate transfer roller 5 is higher by 1% than that of the photosensitive drum 1, that is, Vt=a × Vd(a=1.01).

Figure 8:
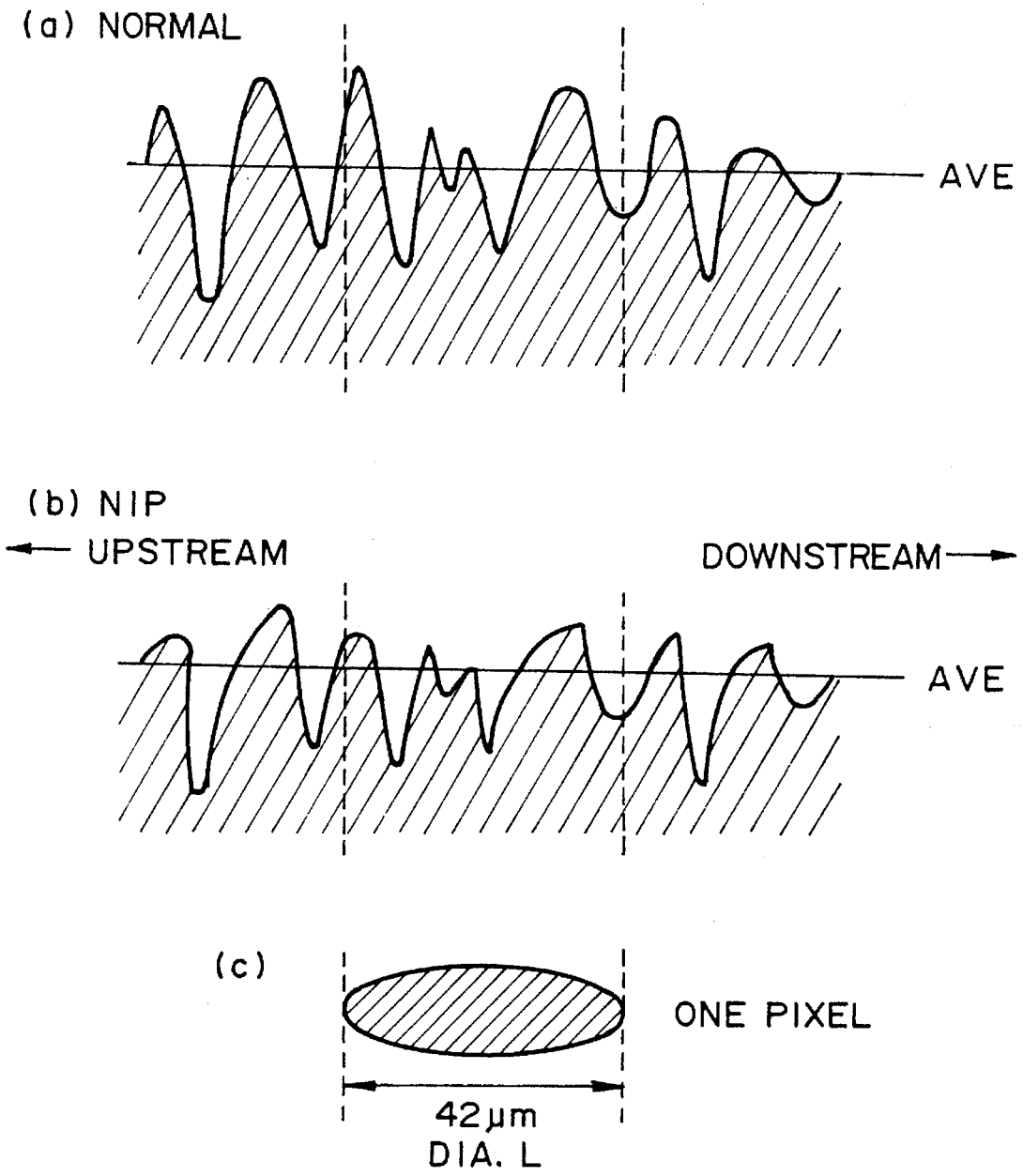
FIG. 8 illustrates change of the surface pits and projections of an intermediate transfer roller by peripheral speed difference between the photosensitive drum and the intermediate transfer roller; (a) shows shapes of the surface pits and projections of the intermediate transfer roller under normal condition; (b) schematically shows the shape of the surface pits and projections when it passes through an image transfer nip; and (c) illustrates a diameter of one pixel size.

FIGS. 8(*a*)–(*c*) show a virtual change of the configurations of the surface pits and projections of the intermediate transfer roller 5 by imparting the peripheral speed difference. In FIG. 8, (a) the surface pits and projections of the intermediate transfer roller 5 are shown under a normal state. In FIG. 8, (b), the projections of the surface pits and projections of the intermediate transfer roller are smoothed toward the downstream by the imparted speed difference, so that the surface roughness Rz is virtually reduced to R'z. When the relation is expressed R'z=f(Rz), the inventors' experiments have revealed that the surface roughness Rz is reduced by approx. 10%, that is:

$$R'z=Rz/f\{(a-1)\times 10+1\}$$

Therefore, better images can be provided than with the first embodiment 1, even if the same intermediate transfer roller is used.

Conversely, by providing the peripheral speed difference, an intermediate transfer roller having a surface roughness Rz which is higher than 10%, is usable. In this case, the usable Rz is:

$$(Rz/1.1)<(L/2)$$

where L is the size of the single pixel.

When the peripheral speed difference is not imparted, that is, when the intermediate transfer member and the photosensitive drum are rotated at the same peripheral speed, the projections on the intermediate transfer roller surface are collapsed at the transfer nip N in a variety of directions, not uniform direction, and therefore, the virtual reduction of the surface roughness Rz is not expected.

In this embodiment, the peripheral speed difference is 1% (1.01), but this value is not limiting. However, the experiments have revealed that the peripheral speed difference is preferably 0.5–3%.

In the printer shown in FIG. 1, the usual white and black image can be produced in the following manner. The photosensitive drum 1 as the first image bearing member is charged by the charger 2, and the charged surface is exposed to the scanning laser beam 31 corresponding to the white and black image information so that a latent image is formed.

The latent image is developed by the black developing device 4BK. The transfer material 8 as a second image bearing member is fed into the transfer nip between the photosensitive drum 1 and the intermediate transfer roller 5, without the toner image being transferred onto the intermediate transfer roller 5 from the photosensitive member 1. Thus, the intermediate transfer roller 5 functions as a transfer roller to transfer the toner image from the photosensitive drum 1 onto the transfer material 8.

Additionally, duplicate (both sides) printing can be simultaneously executed. The toner image of the information which is to be formed on the first side of the transfer material is formed on the photosensitive drum 1 as the first image bearing member, and is transferred onto the intermediate transfer roller 5. Subsequently, a toner image of the image information to be formed on the second side of the transfer material is formed on the photosensitive drum 1, and it is not transferred onto the intermediate transfer roller 5 but the transfer material 8 is fed to the transfer nip N where the photosensitive drum 1 and the transfer roller 5 are contacted to each other, by which the toner images are simultaneously transferred from the intermediate transfer roller 5 and from the photosensitive drum 1 onto the first and second sides of the transfer material 8, respectively.

Figure 9:
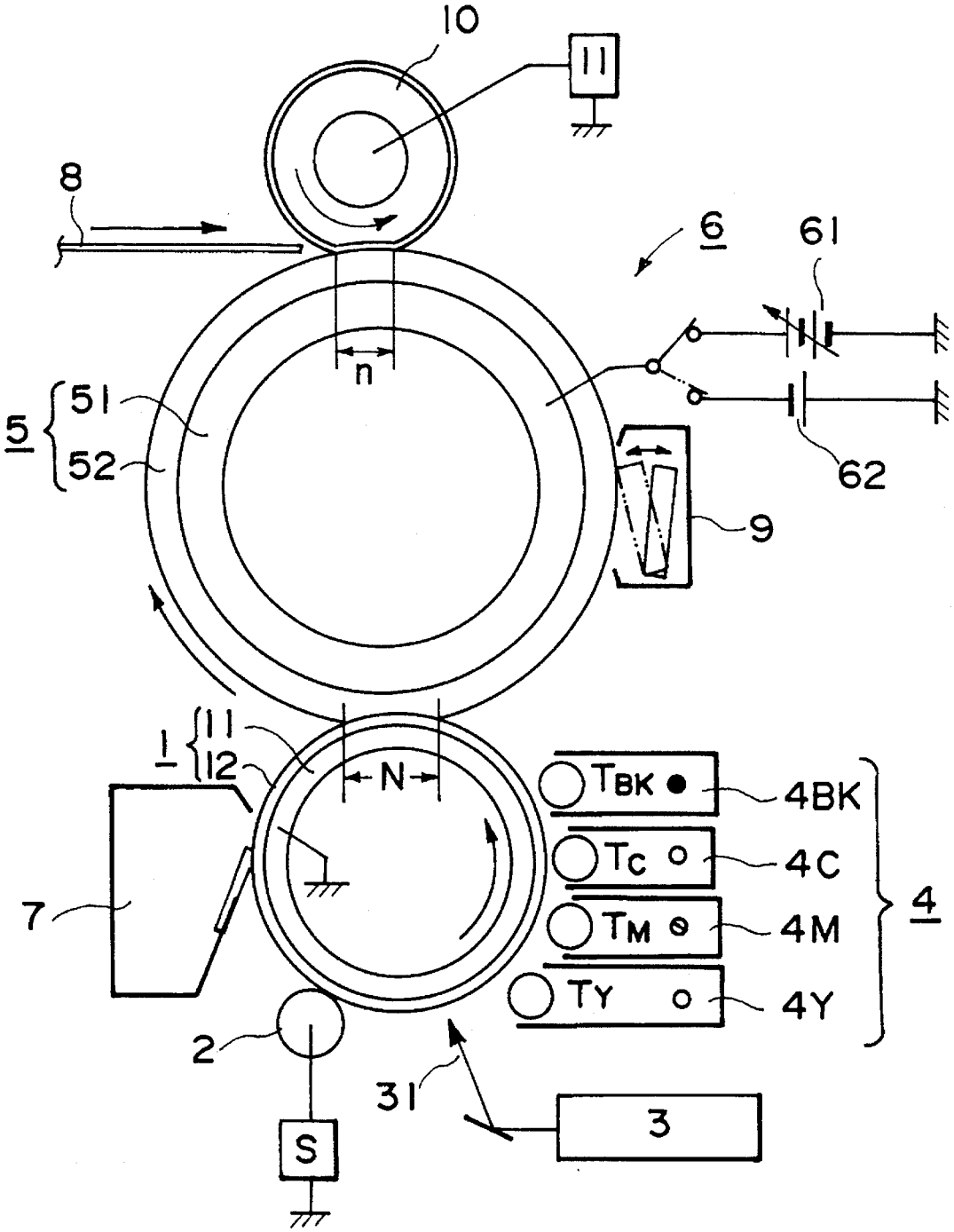
FIG. 9 illustrates a printer having an intermediate transfer roller and a transfer roller.

Alternatively, as shown in FIG. 9, a transfer nip n can be formed between the intermediate transfer roller 5 and the transfer roller 10, and the transfer material 8 is fed into the transfer nip n, by which the toner image transferred onto the intermediate transfer roller 5 can be transferred onto the transfer material 8. Designated by 11 is a transfer bias application voltage source for the transfer roller 10.

Figure 10:
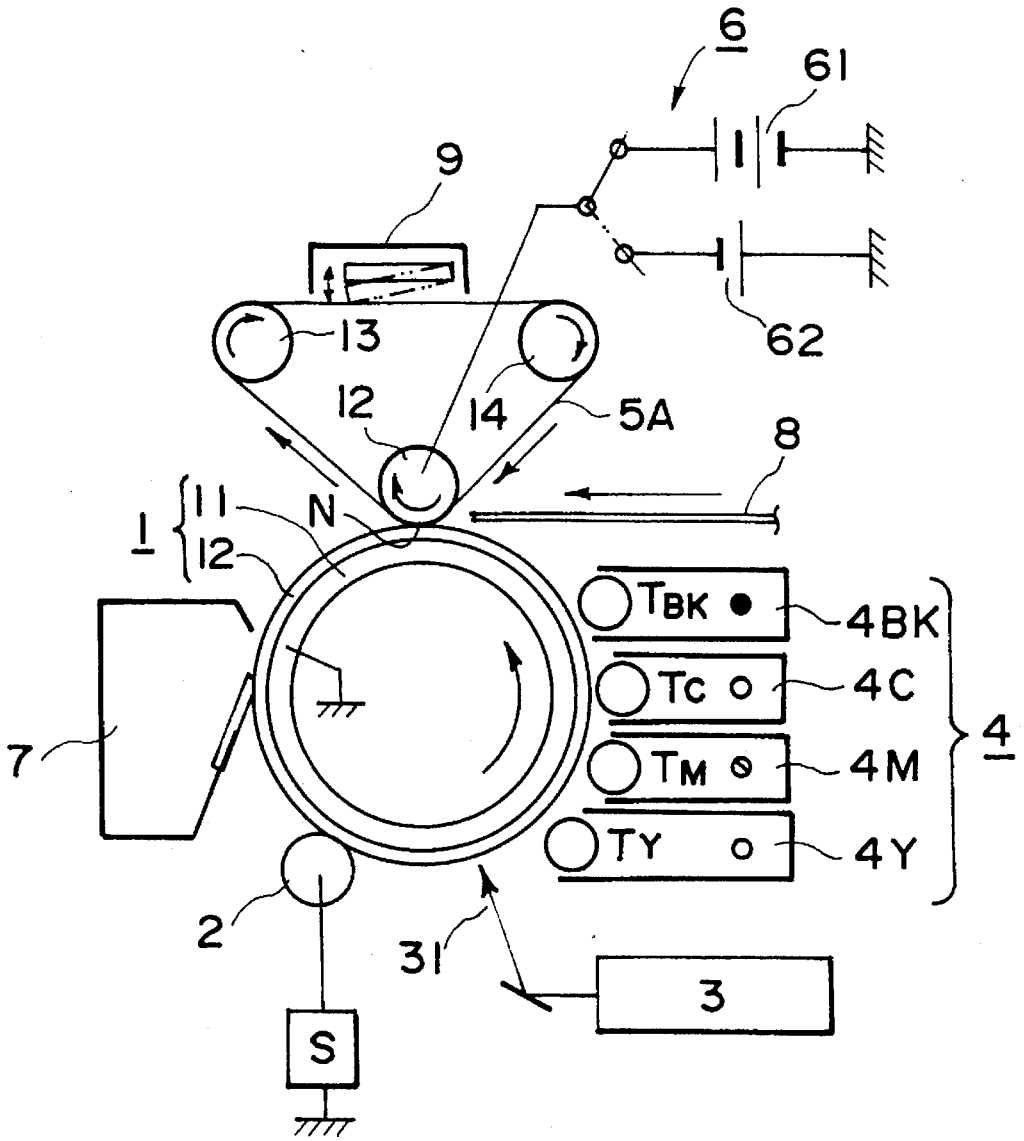
FIG. 10 illustrates a printer having an intermediate transfer member in the form of a rotatable belt.

The configuration of the intermediate transfer member is not limited to the roller type as described hereinbefore. As shown in FIG. 10, it may be in the form of an endless belt (intermediate transfer belt) 5A. Also, in this case, the ten point average surface roughness Rz (JIS B0601) of the transfer belt 5A is smaller than ½ of the diameter L of the single pixel, by which the same advantageous effects as in the foregoing embodiments can be provided.

The endless intermediate transfer belt 5A is stretched around three rollers, namely, electroconductive roller 12, two turn rollers 13 and 14. The conductive roller 12 functions to press-contact the belt 5A to the photosensitive drum 1 with a predetermined pressure. Between the photosensitive drum 1 and the intermediate transfer belt 5A, a transfer nip N functioning as a transfer station is formed.

The intermediate transfer belt 5A is rotated in the direction indicated by an arrow (counterclockwise direction) at the same peripheral speed as the photosensitive drum 1 or with a predetermined peripheral speed difference. The conductive roller 12 is supplied with a transfer bias voltage having the polarity opposite from the charge polarity of the toner forming the image on the photosensitive drum 1, from the first bias voltage source 61. The intermediate transfer belt 5A may comprise a dielectric film of laminated structure having an intermediate resistance, wherein a polyester, polyethylene or another intermediate resistance dielectric film having a backside coated with the conductive material.

As described in the foregoing according to the present invention, even halftone images comprising single dots on the image bearing member can be reproduced on the intermediate transfer member without image disturbance, and different color component images can be faithfully transferred onto the transfer material, so that the quality of the prints is improved.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

image forming means for forming a toner image on said image bearing member;

an intermediate transfer member, contacted to said image bearing member, for receiving the toner image from said image bearing member at the contact position;

wherein a peripheral speed difference a (%) between said image bearing member and said intermediate transfer member satisfies:

$$(0.5 \leqq a \leqq 3)$$

wherein an average surface roughness $R_z$ of said intermediate transfer member and a length L of one pixel satisfy:

$$R_z < (L/2) \times \{(a/10)+1\}.$$

2. An apparatus according to claim 1, wherein a plurality of toner images are overlyingly transferred onto said intermediate transfer member, and the plurality of the toner images are transferred onto a transfer material all together.

* * * * *

UNITED STATES PATENT AND TRADEMARK OFFICE

CERTIFICATE OF CORRECTION

PATENT NO. : 5,519,475
DATED : May 21, 1996
INVENTOR(S) : TOSHIO MIYAMOTO, ET AL.

It is certified that error appears in the above-indentified patent and that said Letters Patent is hereby corrected as shown below:

Column 1,
line 37, "layers," should read --layer,--;
line 44, "by" should be deleted; and
line 53, "are" should read --is--.
Column 2,
line 14, "1" should read --a one--.
Column 3,
line 26, "a four" should read --four--.
Column 5,
line 2, "a absolute" should read --an absolute--; and
line 26, "(nearing," should read --(heating,--.
Column 6,
line 15, "roller 5" should read --roller 5 is--.
Column 7,
line 27, "case of" should read --case where--; and
line 52, "nighest" should read --highest--.
Column 8,
line 56, "uniform" should read --in uniform--.
Column 10,
line 9, "having" should read --has--.

Signed and Sealed this

Seventeenth Day of September, 1996

*Attest:*

Bruce Lehman

BRUCE LEHMAN

*Attesting Officer*

*Commissioner of Patents and Trademarks*